United States Patent [19]

Finden

[11] Patent Number: 5,001,975

[45] Date of Patent: Mar. 26, 1991

[54] APPARATUS AND METHOD FOR THE PRODUCTION OF DEHYDRATED HIGH DENSITY PELLETIZED GARBAGE

[76] Inventor: Kenneth A. Finden, 681 Placita Nueva, Green Valley, Ariz. 85614

[21] Appl. No.: 447,177

[22] Filed: Dec. 7, 1989

[51] Int. Cl.[5] ..... B30B 15/34; B30B 7/04

[52] U.S. Cl. ..... 100/38; 100/37; 100/42; 100/93 P; 100/232

[58] Field of Search ..... 100/37, 38, 41, 42, 100/93 P, 910, 232

[56] References Cited

U.S. PATENT DOCUMENTS

| | | | |
|---|---|---|---|
| 1,490,162 | 4/1924 | Dow | 100/93 P |
| 2,029,984 | 2/1936 | Bottfield et al. | 100/232 |
| 3,070,003 | 12/1962 | Stacy | 100/51 |
| 3,088,499 | 5/1963 | Rieger | 100/232 |
| 3,383,228 | 5/1968 | Rekate et al. | 100/93 P |
| 3,426,673 | 2/1969 | Miner et al. | 100/37 |
| 3,747,516 | 7/1973 | Wood | 100/38 |
| 4,273,581 | 6/1981 | Inoue | 100/38 |
| 4,619,194 | 10/1986 | Pierce | 100/127 |
| 4,691,628 | 9/1987 | Simpson | 100/37 |
| 4,755,332 | 7/1988 | Mizuno et al. | 264/0.5 |

OTHER PUBLICATIONS

John J. Perkins, "Principles & Methods of Sterilization in Health Services", pp. 159–163.

Discover Publication, Inc., 1989, Mark Roman, "What Marvelous Machine in Your Kitchen", pp. 127–130, (Readers Digest).

*Primary Examiner*—Paul T. Sewell

*Assistant Examiner*—Marie D. Patterson

*Attorney, Agent, or Firm*—Charles E. Cates; Frank T. Barber

[57] ABSTRACT

An automated appliance for dehydrating and pelletizing household or other garbage into a sanitized free-flowing form. The apparatus and method provide for compaction and folding of garbage feed material in three directions, to produce a pellet which is held under heat and pressure until computer-programmed temperature, moisture and pressure and points are reached, and the pellet is ejected.

17 Claims, 2 Drawing Sheets

APPARATUS AND METHOD FOR THE PRODUCTION OF DEHYDRATED HIGH DENSITY PELLETIZED GARBAGE

FIELD OF THE INVENTION

This invention relates to apparatus and methods for automated ultra high density compaction of dehydrated garbage, particularly for use in the home. The automated dehydration and compaction system removes odor from garbage and converts it to a free flowing form compatible with industrial materials handling, recycling and energy conversion systems.

BACKGROUND AND PRIOR ART

The problem of garbage disposal has reached critical proportions throughout the world. It is ironic that current practices for handling refuse created by the human race are essentially the same as in prehistoric times—namely: Scratch out a pit for the refuse and cover it with dirt. The current practices account for some of the most distasteful aspects of life in the modern world—unsightly, smelly garbage cans; noisy, energy intensive garbage trucks; expensive collection systems; waste of valuable and vanishing land sites for garbage dumps; air and ground water pollution from the dumps; loss of valuable energy and other resources; and the like.

Proposals for alternatives to the garbage dumps have been made and implemented in the past. For example, U.S. Pat. No. 3,747,516 is directed to the idea of compacting the refuse into specially treated bales and dropping them into the ocean. U.S. Pat. No. 3,426,673 refers to the practice of burning the refuse in incinerators and the problem of air pollution which results. Obviously, approaches such as these are not acceptable under today's environmental standards. U.S. Pat. No. 3,426,673 recognizes advantages to be gained in converting garbage into high density cubes or pellets. However, in said patent, the commercial grade reduction mill, flailing equipment and settling chamber utilized in conjunction with the compaction apparatus for producing the pellets, constitute an approach which is prohibitively complex, expensive and space consuming for use in the typical household.

The present invention is based in part on the recognition that the solution to the garbage problem must be oriented toward steps to be taken at the origin of the problem—namely, the home. Accordingly, it is an object of the present invention to provide a unique method and apparatus, in the home appliance category, for converting the daily output of perishable household garbage into a dehydrated, compacted, free-flowing, storable commodity.

It is a further object of the invention to provide a means of converting household garbage into a sanitized form which may be stored indefinitely thereby eliminating or substantially reducing the health and sanitation problems ordinarily connected with the storing of garbage and also eliminating the need for weekly or even more frequent pick up.

It is another object of the invention to provide a household garbage treatment appliance which is automated for use by the ordinary householder; which fits within the space normally available in kitchens or utility rooms in the home; and which is operable with the utilities normally available in the home.

It is a still further object to provide a system in which the problem is attacked immediately at the beginning of the garbage cycle, to produce dehydrated free-flowing material which enters the commercial commodity market and becomes an economic contributor rather than a problem.

Other objects and advantages will become apparent as the specification proceeds.

SUMMARY OF THE INVENTION

This invention is based on the discovery that household garbage can be efficiently reduced to a hydrated, sanitized pellet form by a series of steps involving compressing the garbage in three different directions to produce the pellet form and then heating the pellet while still under pressure until the pellet reaches certain predetermined end points for temperature, pressure and moisture content. The invention also comtemplates a special combination of apparatus elements for implementation of the foregoing method.

The invention may be described in general terms as a method of dehydrating and pelletizing refuse comprising the steps of loading a hopper with a loose charge of refuse; compressing said charge in the hopper in a first direction to achieve a first reduction of its original hopper volume; transferring the compressed charge to a compaction chamber while further compressing the charge in a second direction to achieve a second reduction of the original hopper volume; further compressing the charge in the compaction chamber in a third direction to achieve a third reduction of the original hopper volume and to produce a pellet; removing moisture from said pellet by heating in the compaction chamber; and ejecting the pellet when predetermined end point values for heat, pressure and moisture are reached.

The apparatus embodiment of the invention may be described in general terms as an apparatus comprising a hopper for receiving a charge of refuse material to be treated; first compression means for closing the hopper while applying compression to the charge of material in a first direction; a compaction chamber communicating with the hopper; second compression means for filling the compaction chamber from the hopper while compressing the charge in a second direction; third compression means associated with the compaction chamber for compressing the charge into a pellet in a third direction, while expressing fluid from the refuse charge; means for applying heat to the pellet while pressure is maintained; means for disengaging the heat and compression means upon attainment of predetermined values of temperature, pressure and moisture in the pellet; and means for ejecting the pellet from the compaction chamber.

The unique automated compaction and dehydration system of the present invention removes odor, moisture and contamination from the garbage and converts it to a free flowing form compatible with industrial materials handling, recycling and energy conversion systems. Because of its densely compacted stable form, the garbage is no longer a perishable product. Rather, it can be stored indefinitely, eliminating the need for frequent pick up. Thus, as one of the benefits of the system, monthly or longer pick up time schedules significantly reduce garbage truck fuel use, noise and traffic problems. Further, instead of the need for expensive, sophisticated vehicles for transporting bulky, perishable garbage, all that is required in the new system are the standard, readily available trucks normally used for hauling free-flowing bulk materials. The result is a system compatible with existing industrial transport, storage, conveying and handling equipment.

As a further advantage, with home solid wastes in the dry pellet form, they become adaptable to a wide variety of resource recovery techniques. Under appropriate conditions, they can be burned directly as a commercial or even a home energy source, with minerals recoverable from the ash. They can be processed through recycling systems to separate and recover plastics, paper, metals, etc. Thus, they enter the commercial commodity market and become an economic contributor similar to scrap metal, recycled paper, and other low value commodities. Even if particular locality requirements contemplate sending the pellets to a land fill, the highly compacted, sanitized, deodorized form of the garbage results in a land fill superior in many respects to the present day concept of a garbage dump.

Although the method and apparatus of the present invention are uniquely suited for the treatment of garbage at the local household level, the invention may also be used for larger applications, such as multiple dwelling apartments, hotels, restaurants, commercial and industrial operations, and the like.

BRIEF DESCRIPTION OF THE DRAWINGS

The objects, features and advantages of the invention will be apparent to those skilled in the art from the following detailed description, taken together with the accompanying drawings, in which.

DETAILED DESCRIPTION OF THE INVENTION

Figure 1:
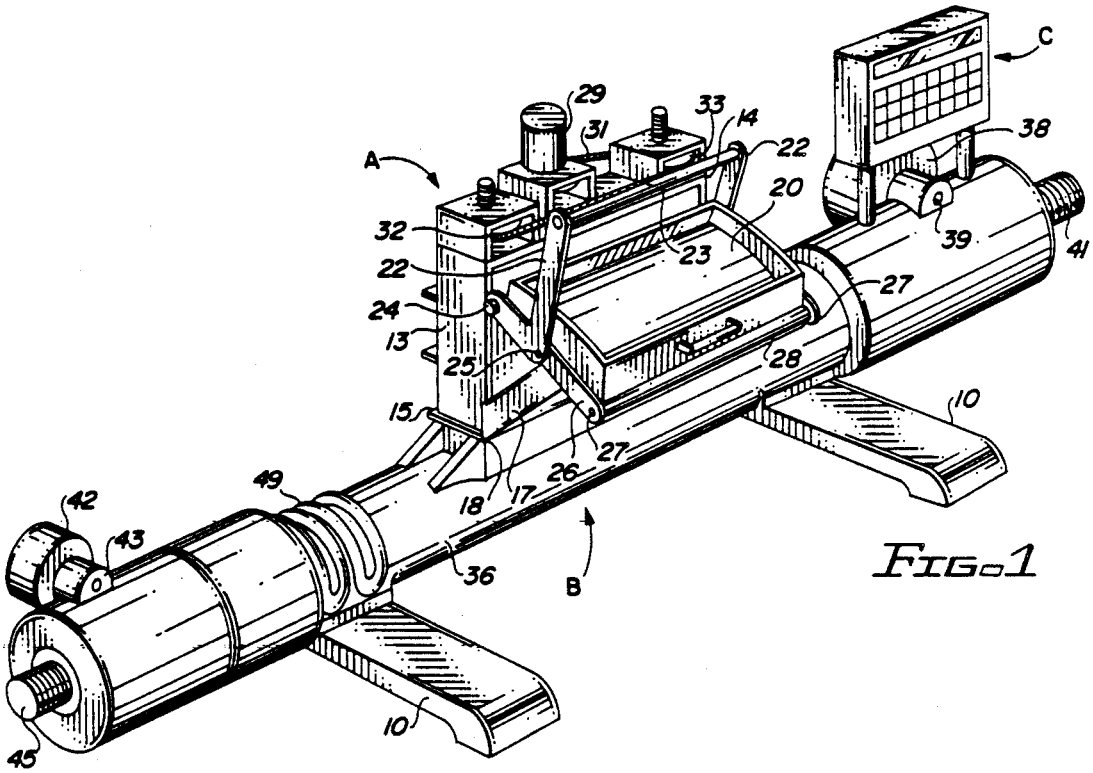
FIG. 1 is an overall perspective view of a pelletizing dehydrating machine embodying the present invention.

As illustrated in FIG. 1, the apparatus includes a hopper unit A, a compaction chamber or tube B and a computerized control unit C. The apparatus has a pair of legs 10, upon which the compaction tube B is mounted. In turn, the hopper unit A and the control unit C are mounted on the compaction tube B at the locations shown.

The hopper A is a generally rectangular chamber having a pair of side walls 11 and 12 (best shown in FIGS. 2A through 2E). It has another pair of side walls 13 and 14 of smaller dimension (best shown in FIG. 1 and FIG. 3A); and it has an open bottom which registers at point 15 with an opening in the top wall of the compaction tube B.

Figure 2A:
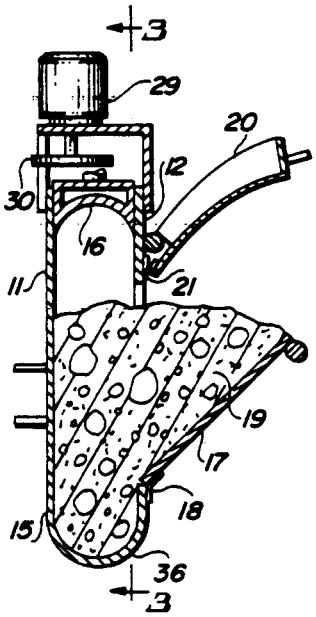
FIG. 2A is a sectional end view of the machine showing both the hopper door and its cover in open position, the section being taken along line 2—2 of FIG. 3A.
Figure 2B:
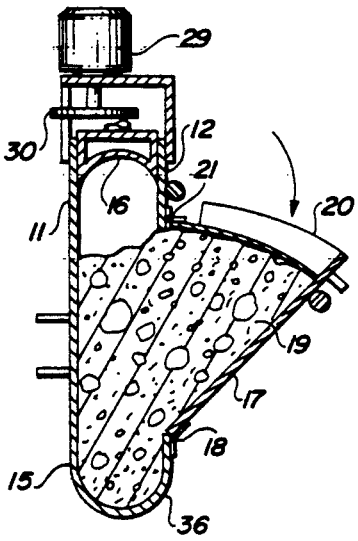
FIG. 2B is a sectional end view showing the hopper door open but its cover closed, the section being taken along line 2—2 of FIG. 3A.
Figure 2C:
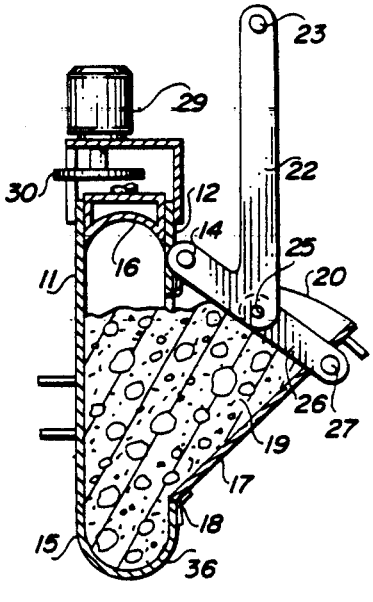
FIG. 2C is a sectional end view similar to FIG. 2B but with an end view of the over-center toggle linkage handle added.
Figure 2D:
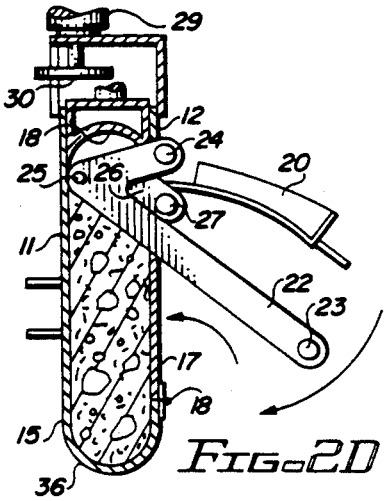
FIG. 2D is a sectional end view similar to FIG. 2C but with the over-center toggle linkage handle having been moved to rotate the hopper door to closed position.
Figure 2E:
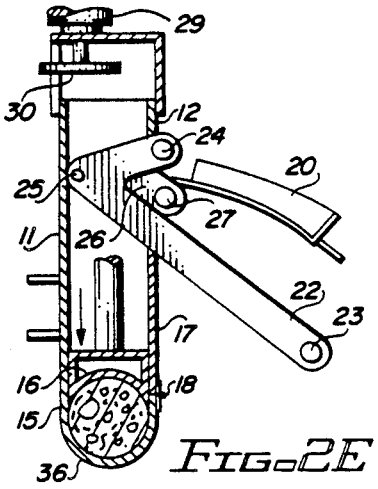
FIG. 2E is a sectional end view similar to FIG. 2D but with the first ram means having been moved downwardly to its compression position.

The top or upper end wall 16 of hopper A is a reciprocating member adapted to be moved from its upper or proximal end (as shown in FIGS. 2A through 2D) to its lower or distal end (as shown in FIG. 2E). It will be noted that, in the embodiment shown, the reciprocating member 16 has a ram face which is concave and is configured to match the general size and shape of the opening in the top wall of compaction tube B. When reciprocating member 16 is at its lower or distal end, it operates to form a rigid closure of the opening in the top wall of the compaction tube, as shown in FIGS. 2E and 3A.

Side wall 12 of the hopper A includes a hinged door 17 for opening the hopper to receive a charge of refuse and for closing the hopper while applying compression to the charge. Door 17 occupies substantially all the area of side wall 12 and is hinged along the length of its bottom at point 18 to provide top-opening access to the hopper. In its open position, the door 17 provides a preliminary loading area 19 where refuse may be received and held until the door is closed and operation of the machine begins. The door is equipped with a cover 20 which is hinged along the length of its top at point 21, so that the cover can be held in an open position while a charge of refuse is being loaded and then brought to a closed position (as shown in FIGS. 2B through 2E) for containment of the garbage while the door 17 is being closed.

Door 17 is provided with an over-center toggle mechanism for leveraging its closure. As best shown in FIG. 1 and FIGS. 2C through 2E, the toggle mechanism includes, at each end of the door, modified V-shaped lever members 22 joined at one end by a handle cross-bar 23 and pivoted at the other end at a major pivot point 24. At the apex of the V, each lever member 22 is joined at a secondary pivot point 25 to one end of a corresponding second lever member 26. The other end of each lever member 26 is pivotally joined to opposing top ends of the door 17 at pivot points 27, which are joined together by pivot rod 28. When downward manual pressure is applied to handle cross-bar 23, the over-center toggle mechanism serves to leverage the door to a closed position, as shown in FIG. 2D, thus transferring the refuse held in preliminary loading area 19 into the interior of hopper A while applying compression to the refuse in an angular direction.

Figure 3A:
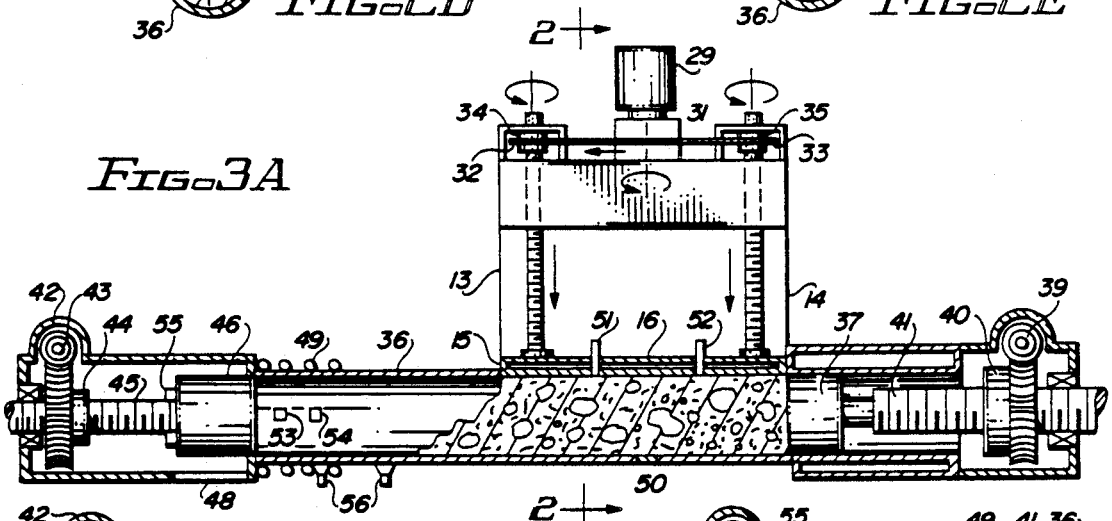
FIG. 3A is a sectional side view of the complete machine, showing the first ram means having been moved downwardly to its compression position and the second ram means in its withdrawn position, the section being taken along line 3—3 of FIG. 2A.

In the embodiment shown in the drawings, the reciprocating member 16 inside the hopper A is made to operate as a ram, moving back and forth between its upper or proximal position and its lower or distal position by means of twin screws, as best shown in FIG. 3A. Thus the hopper is provided with a reversible electric motor 29 which drives a main sprocket 30 which in turn works through chain 31 and twin sprockets 32 and 33 to impart synchronized rotational motion to twin Acme screw thread drives 34 and 35, shown in FIG. 3A. The rotation of the screw thread drives 34 and 35 causes member 16 to move up or down depending on the command received by the electric motor 29 from the control module C. When member 16 is at its upper or proximal end and the hopper A has been filled with partially compressed refuse by the closing of door 17, activation of motor 29 causes member 16 to move to its lower or distal end, thus transferring the refuse into the compaction chamber B while compressing the refuse in a second direction. It will be understood that any suitable motorized or manual means for moving ram member 16 may be used. However, the synchronized twin screw embodiment shown in the drawings is useful in handling potential uneven distribution of material which may be found in garbage.

For commercial or semi-commercial situations, where more space is available and greater quantities of garbage are to be handled, it is within the scope of the invention to provide automated means for feeding multiple hopper cartridges sequentially into the hopper A. For example, cartridges conforming generally to the shape of the mid-section of hopper A (including the hopper door 17) can be set up on a carousel or in-line configuration, so that cartridges can be injected seriatim into hopper A and then, after a compression cycle is completed, replaced with the next cartridge, which has been filled with garbage while waiting its turn. However, for a household application, the single cartridge arrangement shown in the drawings is the most efficient and preferred embodiment.

The compaction chamber B comprises a heavy duty tube 36 having an opening in its upper lateral wall which registers with the opening in the bottom of hopper A and which has generally the same size and shape as the ram face member 16 of hopper A. Thus, compaction chamber B is connected to hopper A at the point 15, and there is communication between the chamber and hopper through the opening referred to.

In a preferred embodiment, the inside diameter of tube 36 is approximately the same as the distance between hopper door 17 and its opposite side wall 11 when the hopper door is closed. This inside diameter governs the size of the pellets to be produced, and generally a tube having an inside diameter of 2½ or 3 inches is preferred. The tube 36 must withstand substantial strain during the compression cycle and is constructed preferably from heavy duty metal with dimensions commensurate with the strain being encountered. Thus, for a 2½" inside diameter tube, the preferred thickness of the walls is in the range of 0.25 to 0.6 inches. For a 3" inside diameter tube, the preferred thickness is in the range of 0.3 to 0.75 inches. In the embodiment shown in the drawings, the length of tube 36 is approximately 25 inches, and the overall length of the tube and its associated drive mechanisms (to be described) is approximately 35 inches, thus providing a compact configuration for a household environment.

Compaction chamber B is provided at one end with a ram mechanism which is operable to drive a ram face 37 along the longitudinal axis of tube 36. The mechanism comprises a high torque reversible electric motor 38 with a direct drive to a worm gear drive 39 which turns a ball screw nut 40, thus causing movement of the screw 41 and its associated ram face 37. Other arrangements (e.g., Acme screw thread drives) for driving the ram are contemplated within the scope of the invention. However, in view of the high stress requirements for obtaining the degree of compaction desired for the pellets, the efficiency and capacity of a ball screw drive is preferred, particularly in combination with the worm gear drive shown in the drawings.

Figure 3B:
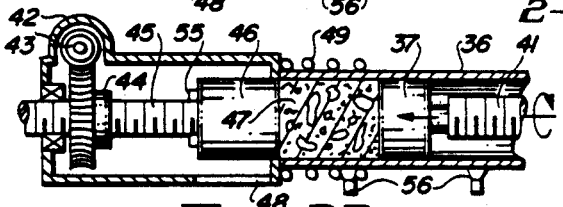
FIG. 3B is an enlarged sectional side view of the compression end of the compaction chamber, showing the second ram means approaching its final compression position, the section being taken along line 3—3 of FIG. 2A.

At the other end of tube 36 a tube closure is provided, comprising a reversible electric motor 42 with a direct drive to a worm screw 43 which turns a ball screw nut 44, thus causing movement of screw 45 and its associated false pellet 46. In its extended position, false pellet 46 provides a releasable closure for the end of tube 36, as shown in FIGS. 3A and 3B. The face of the false pellet is slightly smaller in diameter than the inside diameter of tube 36, thus allowing a small gap for water expressed from the garbage to be expelled and collected in a manifold (not shown) positioned below the machine. The manifold also collects water drained from within tube 36 through outlets 56. When withdrawn to its retracted position, false pellet 46 is removed from the end of tube 36 and allows ejection of the garbage pellet 47 from the compaction tube. The ejected pellet drops through the opening 48.

Alternate embodiments of the false pellet mechanism are also contemplated within the scope of the invention. For example, the electric motor 42 and its associated worm drive 43 may be replaced with a manual crank for turning the false pellet into its closed or open position. Similarly, rotating or guillotine mechanisms may be used for inserting or retracting the false pellet. However, the automated mechanism shown in the drawings is preferred.

The compaction tube 36 is also provided with an electric heating coil 49, encircling the tube at the end point where the garbage pellet 47 is held between ram face 37 and false pellet 46 in their extended positions. A source of electricity (not shown) serves to heat the coil 49 and thus provide heat for a predetermined time to a predetermined temperature end point while the pellet 47 is in position adjacent the coil.

The compaction tube 36 is provided with a moisture sensor 50 in the wall of the tube at the point where the charge of refuse is transferred into the tube from the hopper A. Water spray nozzles 51 and 52 (which draw water from a source not shown) are also located in the ram face 16 at this point, so that when the moisture sensor 50 (and its associated computer controls) detect a deficiency of moisture in the charge of garbage, the spray nozzles may be activated to supply the needed moisture. The compaction tube 36 is also provided with a temperature sensor 53 in the wall of the tube at the point where the pellet 47 is held adjacent the heat coil 49, and an additional moisture sensor 54 is located in the tube wall adjacent that point. A pressure sensor 55, such as a load cell, is provided in line between the screw drive 45 and the false pellet 46 to provide a readout of pressure value while the garbage pellet is held between the ram face 37 and the false pellet 46.

As shown in FIG. 1, a computerized control unit C is positioned at one end of the compaction chamber B and has input/output capabilities useful in controlling the automated operation of the dehydrater pelletizer of the present invention. In general terms, the control unit includes a computer which receives temperature, moisture and pressure values from sensors 50, 53, 54 and 55, compares them with predetermined default values stored in the computer, and then in programmed response to such comparison, sends activating signals to the various rams, spray units, and heating elements in the sequences commanded by the program.

Figure 4:
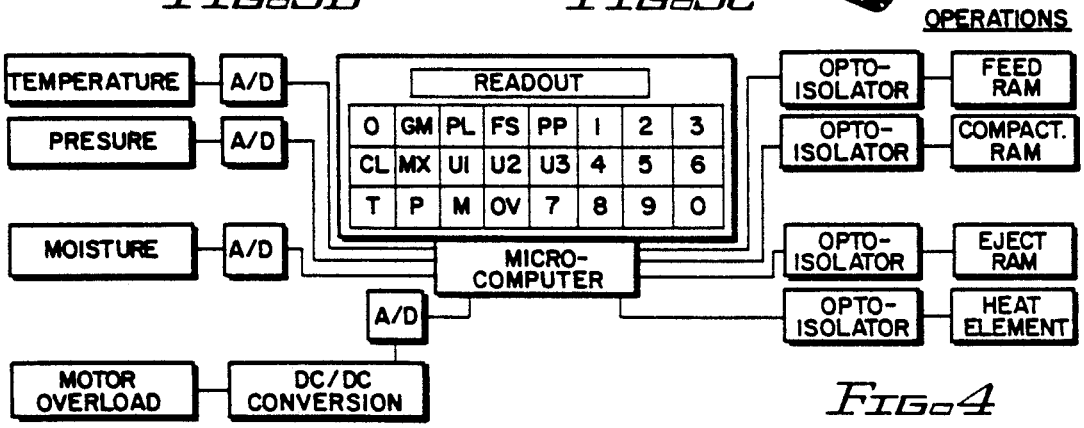
FIG. 4 is a diagram of the computerized control system.

In greater detail, referring to FIG. 4, the computer associated with the control unit C is programmed to store a separate set of predetermined temperature, pressure and moisture end points most suitable for each of the common types of garbage encountered in the home. The computer is also programmed to command an operational sequence which is specific for each of said types of garbage. Prior to starting operation of the machine, a particular set of end points, and a particular operational sequence, may be selected, depending on the type of garbage being processed, by pressing an appropriate button on the control panel. For example, as shown on the control panel of FIG. 4, there are separate selection buttons designated "GM" for the general mixture of garbage normally found in the home; "PL" for garbage containing predominant proportions of plastic; "FS" for garbage which is mainly foodstuffs; and "PP" for garbage which is mainly paper products For garbage mixtures which do not fit any of the above general categories, an additional selection ("MX") is provided to invoke conservative default values for the end points, these values being adjustable by use of the number pad on the control panel. Also, for previously untested materials, selection buttons "U1", "U2" and "U3" are provided, which may be used in conjunction with the number pad to create sets of end points for experimentation and eventual storage for future use. The control panel further includes an "O" button for turning the operation on or off, and a "CL" button for initiating a cleaning sequence.

The computer in the control unit C is connected through analog/digital converters to the moisture sensors 50 and 54, the temperature sensor 53 and the pressure sensor 55, thereby enabling sensing of such values for comparison with the predetermined end points which have been programmed. Likewise, as shown in FIG. 4, motor overload sensors in each of the motors 29, 38 and 42 are connected to the computer through similar analog/digital converters. The control unit also includes, in the linkage between the computer and the various rams and heating elements, a series of opto-isolators (LEDs for triggering solenoid activated switches).

OPERATION OF THE SYSTEM

The operating cycle of the system is initiated by manually loading a charge of garbage into the hopper A. This may be accomplished over a period of time, as the garbage collects, or it may be done all at one time from a garbage holding bin maintained for that purpose. It is an advantage of the invention that the system is capable of handling the normal mix of garbage components generated in the home, including not only the usual run of foodstuffs but also the various paper and plastic products, and even metal containers such as aluminum or tin cans. However, caution should be used at this point to remove residual contents of the containers and to dispose of any aerosols or containers for toxic, flammable or otherwise hazardous materials by other proper means.

During loading of the loose charge of refuse into the hopper, both the hopper door 17 and its cover 20 are in their open position, as shown in FIG. 2A. When the hopper A and the preliminary loading area 19 have been filled, the door cover is brought to its closed position, as shown in FIGS. 1 and 2B, and then the handle 23 is manually lowered to the position shown in FIGS. 2D and 2E. The lowering of the handle causes its associated over-center toggle mechanism, comprising levers 22 and 26, to leverage door 17 to its fully closed position. The closing of the door causes the charge of loose garbage to be compressed and folded in an angular direction, and the compression results in the first in a series of volume reductions to be encountered in the cycle. At this stage of the operation, the garbage in hopper A, as shown in FIG. 2D, has been reduced to a volume of about 55–65% of the original volume, before compression.

After the first compression, as above, the manual operation is complete, and the control system C with its micro computer is activated to take over the pelleting process by first pressing the "O" button and then pressing the "GM", "PL", "FS" or "PP" button on the control panel to select the particular set of temperature, pressure and moisture end points and the particular operational sequence for the type of garbage being treated.

When the appropriate selections have been made, the automated operation shown in FIGS. 2E, 3A, 3B and 3C begins. The electric motor 29, with its associated arrangement of chain 31, sprockets 32 and 33, and twin screws 34 and 35 drives ram member 16 from its position at the top of hopper A (as shown in FIG. 2D) to its position at the lower end of the hopper (as shown in FIGS. 2E and 3A). As a result, the preliminarily compacted charge of garbage in hopper A is transferred to compaction chamber B through the opening 15, while at the same time further compressing and folding said charge in a second direction. This compression results in a second reduction in volume of the charge, such that, at this stage, the charge has been reduced to about 10–20% of its original volume. Ram member 16 is maintained in its extended position for the remainder of the pelletizing cycle.

At this point, the moisture sensor 50 provides a reading of the moisture content of the compressed charge of garbage held in the position shown in FIG. 3A. If the moisture level is above a predetermined point for the type of garbage being treated, the computer will recognize the need for heat later in the cycle. If a deficiency of moisture is detected, water sprays 51 and 52 are activated to provide make-up water. Following this, electric motor 38 is energized and, through its associated arrangement of worm gear drive 39, ball nut 40, and screw 41, drives ram face 37 from its retracted position as shown in FIG. 3A to its extended position as shown in FIG. 3B. Thus, the ram causes the charge of garbage to be folded and compressed in a third direction, this time in a direction generally perpendicular to the second direction which was taken in hopper A.

It will be noted that, during the ram action in compaction chamber B, as just described, the hopper ram face member 16 is held in its lower, extended position. Since member 16 has substantially the same size and shape as the opening in the upper wall of compaction tube B, it forms a rigid closure for such opening as long as it remains in its extended position. Thus, member 16 is held in such position to maintain the integrity of the upper wall of compaction tube B during the movement of ram face 37 through compaction tube B.

The ram action in compaction tube B, as above described, causes the charge of garbage to be compressed against false pellet 46, which forms a closure at the end of tube B. Such compression brings about a third reduction in volume and results in a highly compressed pellet 47 having approximately 3–5% of its original volume. The compression also acts to express excess free moisture, which is discharged through the gap around the circumference of false pellet 46, and through outlets 56 into a manifold to the sewer. While the pellet 47 is held under pressure by the opposing action of ram face 37 and false pellet 46 and their associated drive mechanisms, heating element 49 is activated to raise the temperature of the pellet and further reduce the moisture level as desired.

Figure 3C:
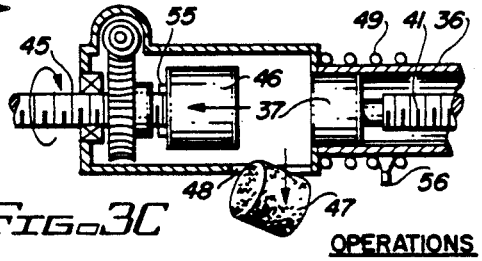
FIG. 3C is an enlarged sectional side view similar to FIG. 3B, showing ejection of the pellet.

While the pellet 47 is thus being held and heated, the temperature sensor 53, moisture sensor 54 and pressure sensor 55 are transmitting readings to the computer in control unit C, and when the respective values reach their programmed end points, the control unit sends a signal to activate motors 38 and 42, causing retraction of both the ram face 37 and the false pellet 46. The pressure on the false pellet is thus relaxed, and the pellet is ejected from the machine by a short re-activation of ram face 37, causing the pellet 47 to drop from compaction tube B through opening 48, as shown in FIG. 3C.

With the ejection of the pellet, the cycle is complete, and the various rams and manual elements are returned to their original positions. Thus, the ram face 16 in hopper A is returned to its retracted position at the upper end of the hopper, as shown in FIG. 2A; ram face 37 is returned to its retracted starting position, as shown in FIG. 3A; and false pellet is returned to its extended position, forming an end closure for compaction tube B, as shown in FIG. 3A. Also, the door 17 and its cover 20 are manually opened, ready to receive the next charge of loose garbage.

The pellets which are ejected from the compaction chamber make up a completely dehydrated, sanitized, deodorized, free-flowing product which may be stored for extended periods and which is compatible with industrial materials handling, recycling and energy conversion systems. It will be understood that, as ejected from the compaction tube, the pellets are in a heated state and should be cooled or otherwise brought to ambient temperature, to avoid picking up condensation prior to packaging or otherwise confining.

Since garbage is inherently unsanitary in its raw state, it is essential that equipment for handling it be readily cleansed. It will be noted that the dehydrater pelletizer of the present invention includes an automated cleaning cycle, based on internal flushing, which is effective in maintaining a sanitary condition consistent with being located in the household. In operation of the cleaning cycle, an inexpensive cellulosic material, such as crumpled newspaper, is loaded into the open door of hopper A. With the door 17 still open, but with its cover 20 closed, high pressure water jets (not shown) are activated to over wet the newspaper. Door 17 is then closed to compress the newspaper in the hopper A. The control unit C is next used to initiate a complete automated cycle of the machine, with the newspaper ultimately being ejected as a dewatered pellet. The automated cycle is initiated by pressing the "On" button on the control panel and then the "CL" button. In the cycle, the electric motor 29 and its associated chain, sprockets, and twin screws cause ram face 16 to move to its extended position, compressing and transferring the newspaper into the compaction chamber B. Additional water is added through jet spray nozzles 51 and 52, and then motor 38 and its associated worm drive, ball screw nut and screw drive cause the ram face 37 to move to its extended position, compressing the newspaper, without heat, against false pellet 46 and ultimately ejecting a compressed, dewatered newspaper pellet through the opening 48. Processing newspaper through the system, as described, is an effective cleaning procedure, since the newspaper wipes the interior walls of the equipment, and the fibrous nature of the newspaper allows water to be forced at high pressure through the system and into the sewer manifold without clogging the various orifices and gaps as would a build-up of food or other garbage particles.

The cleaning procedure includes a second cycle, omitting the use of newspaper. With the hopper door cover closed, high pressure water is introduced into the hopper A, and then, with the door 17 closed, the usual automated compression cycle is repeated, including the application of heat supplied by the electric heating elements 49. In this manner, clear water is flushed through the system, through the gaps and orifices and into the manifold, cleaning out any remaining materials. Solvents or detergents may be added if desired.

In view of the diverse forms, sizes and materials encountered in garbage, means are provided in the system for dealing with jamming and the resulting overloading of the drive mechanisms. Unusual ingredients in the garbage, such as very dense materials, heat treated steel, or other thick, strong objects are potential jamming materials. A degree of discretion on the part of the operator, or a pre-sorting program, is required to prevent obvious cases of overloading. However, to handle actual overloading conditions, the motors 29, 38 and 42 are provided with overload circuit breakers and are in communication with the "OV" button on the panel of the control unit C. Thus, in a jam condition, pressing the "OV" button will initiate a cycle allowing on and off reversal of the motors to eliminate the jam. Backup shear devices (not shown) are provided in each of the drive mechanisms for extreme cases of jam.

As previously indicated, the computer associated with the control unit C is programmed to store temperature, moisture and pressure values to be used for each of the various types of garbage ordinarily encountered. Thus, prior to starting the automated dehydrating pelleting cycle, the operator can use the buttons on the control panel to choose the appropriate values for the particular type of garbage being treated. The temperature values will ordinarily be within the range from 180° to 500° F. The moisture end point value is preferred to be in the range from 12 to 15%, and the pressure used will be from 200 to 10,000 pounds per square inch. It is possible to operate the apparatus using predetermined standard operating conditions for temperature and pressure, and eject the pellet when a predetermined end point for moisture has been sensed.

When the "GM" button is pushed to initiate the pelleting cycle for the general mixture of garbage, the pre-set pressure operating condition should be at a high level (e.g., 8,000 psi) to obtain the maximum compaction or crushing to take care of the glass and metal normally contained in this type of garbage, and for the low amount of moisture in this type of material, a temperature value at the lower end of the range is adequate. A set of typical values for the "GM" mixture will be 8,000 psi for pressure, 200° for temperature, and 15% moisture.

When the "PL" button is used to activate the pelleting cycle for plastic packaging materials, it is important that sufficiently high temperature values be used. Plastics have a memory that tends to return the package to its original shape if compacted cold and the pressure released. It is also necessary that the plastic then be held in the compaction chamber until the temperature drops below the formable temperature before ejection. A typical set of values for the "PL" cycle will be 3,000 psi for the pressure, 15% for the moisture content, and a temperature passing through a peak of 300° F. and ending at 175° F. when the pellet is ejected.

In the use of the "FS" button for treatment of food stuffs, it is necessary that sufficient moisture be present in the raw material to convert the cellulose normally present into the desired hard, durable pellets. Therefore, the computer cycle for this material should include sensing the moisture content when the garbage is transferred to the compaction chamber and then adding sufficient water to bring the moisture content to 25–30%. Heat and pressure will then be applied to reduce the moisture to about 15% before ejection of the pellet. A typical set of values for the "FS" cycle will be 6,000 psi for the pressure, 250° F. for the temperature, and a moisture end point of 15%. Similar values are suitable for the "PP" cycle for paper products.

Although preferred embodiments of the invention have been described herein in detail, it will be understood by those skilled in the art that variations may be made thereto without departing from the spirit of the invention.

What is claimed is:

1. Apparatus for dehydrating and pelletizing refuse comprising:

(a) hopper means for receiving a charge of refuse material to be treated;

(b) first compression means for closing said hopper while applying compression to said charge of material in a first direction;

(c) a compaction chamber communicating with said hopper;

(d) second compression means for filling said compaction chamber from said hopper while compressing said charge in a second direction;

(e) third compression means associated with said compaction chamber for compressing said charge to a pellet in a third direction, while expressing fluid from said refuse;

(f) means for applying heat to said pellet while pressure is maintained;

(g) means for disengaging said heat and compression means upon the attainment of predetermined values of temperature, pressure and moisture in said pellet; and (h) means for ejecting said pellet from said compaction chamber.

2. The apparatus of claim 1 wherein said first compression means comprises a hinged door which may be closed on said charge of refuse material to apply compression in an angular first direction.

3. The apparatus of claim 1 wherein said second and third compression means are arranged for exerting compression in directions normal to each other.

4. The apparatus of claim 1 wherein said means for applying heat to said pellet comprises an electrical heater.

5. The apparatus of claim 1 including sewer outlet means for receiving said fluid expressed from said refuse.

6. Apparatus for dehydrating and pelletizing refuse comprising:

(a) a hopper for receiving a charge of refuse material to be treated, said hopper comprising a generally rectangular chamber having four side walls, an open distal end, and a reciprocating wall at its proximal end functioning as a ram face, one of said side walls including a door for opening said hopper to receive said charge of material and for closing said hopper while applying compression to said charge of material in an angular direction;

(b) a compaction tube located adjacent said hopper, having a releasable end closure and having a wall opening registering with the open distal end of said hopper, the longitudinal axis of said compaction tube being substantially normal to the longitudinal axis connecting the proximal and distal ends of said hopper;

(c) first ram means for moving said reciprocating wall of said hopper from an open position adjacent the proximal end of said hopper to a compression position adjacent the distal end wherein the ram face of said reciprocating wall forms a rigid closure of the wall opening of said compaction tube, the movement of said ram means causing refuse material in said hopper to be transferred to said compaction tube while compressing said material in a direction substantially normal to the longitudinal axis of said tube;

(d) second ram means, located in said compaction tube, for compressing said refuse material in a direction along the longitudinal axis of said compaction tube against said releasable end closure to thereby form a pellet while expressing fluid from said material;

(e) an electrical heating element on said compaction tube for applying heat to said pellet;

(f) means for sensing and signalling the values of temperature, pressure and moisture content of said pellet while pressure and heat are being applied;

(g) means responsive to the signals from said sensing means for disengaging said heat and compression means upon the attainment of predetermined values of temperature, pressure and moisture in said pellet; and (h) means for releasing said releasable end closure in said compaction tube for ejecting said pellet from said compaction chamber.

7. The apparatus of claim 6 including a cover for containment of said charge of refuse material while said door is being closed.

8. The apparatus of claim 6 wherein the diameter of said compaction tube is approximately the same as the distance between the hopper door and its opposite side wall when said hopper door is closed.

9. The apparatus of claim 6 including sewer outlet means for receiving said fluid expressed from said refuse.

10. The apparatus of claim 6 including means for programming said predetermined values of temperature, pressure and moisture depending upon the type of refuse contained in said charge.

11. The apparatus of claim 6 wherein the ram face of said reciprocating wall of said hopper is concave and configured to match the general shape and size of the said wall opening in said compaction tube, said ram face operable to form a rigid closure of said opening during compression of said refuse material by said second ram means.

12. Apparatus for dehydrating and pelletizing refuse comprising:

(a) a hopper for receiving a charge of refuse material to be treated, said hopper comprising a generally rectangular chamber having substantially vertical side walls, an open bottom, and a vertically reciprocating top wall functioning as a ram face, one of said side walls including a bottom-hinged door for opening said hopper to receive said charge of material and for closing said hopper while applying compression to said charge of material in an angular direction;

(b) a generally horizontally positioned compaction tube located below said hopper and having a releasable end wall and having an upper wall opening registering with the open bottom of said hopper;

(c) first ram means for moving said upper wall of said hopper from an open position adjacent the top of said hopper to a compression position wherein the ram face of said upper wall forms a rigid closure of the upper wall opening of said compaction tube, the movement of said ram means causing refuse material in said hopper to be transferred to said compaction tube while compressing said material in a vertical direction;

(d) second ram means for compressing said refuse material in a horizontal direction in said compaction tube against said releasable end wall to thereby form a pellet while expressing fluid from said material;

(e) an electrical heating element on said compaction tube for applying heat to said pellet;

(f) means for sensing and signalling the values of temperature, pressure and moisture content of said pellet while pressure and heat are being applied;

(g) means responsive to the signals from said sensing means for disengaging said heat and compression means upon the attainment of predetermined values of temperature, pressure and moisture in said pellet; and (h) means for releasing said releasable end wall in said compaction tube for ejecting said pellet from said compaction chamber.

13. A method of dehydrating and pelletizing refuse comprising the steps of:

(a) loading a hopper with a loose charge of refuse;

(b) compressing said charge in said hopper in a first direction to achieve a reduction of said charge to about 60–65% of its original hopper volume;

(c) transferring said compressed charge to a compaction chamber while further compressing said charge in a second direction to achieve a reduction of said charge to about 10–20% of the original hopper volume;

(d) further compressing said charge in said compaction chamber in a third direction to achieve a reduction of said charge to about 3–5% of the original hopper volume;

(e) removing moisture from said pellet by heating in said compaction chamber;

(f) sensing the moisture value of said pellet in said compaction chamber; and (g) ejecting said pellet when a predetermined end point value for moisture is reached.

14. The method of claim 13 wherein the direction of compression in said second reduction is normal to the direction of compression in said third reduction.

15. The method of claim 13 wherein said charge is held under compression in said first direction while being compressed in said second direction and is held under compression in said second direction while being compressed in said third direction.

16. The method of claim 13 wherein the heating of said pellet is carried out by electrical means.

17. A method of dehydrating and pelletizing refuse comprising the steps of:

(a) loading a loose charge of refuse into a hopper equipped with a bottom-hinged, side opening door;

(b) compressing said charge in said hopper in a first direction by leveraging said door to a closed position, said compression achieving a reduction of said charge to about 60–65% of its original hopper volume;

(c) moving a ram in said hopper to transfer said compressed charge to a compaction chamber while further compressing said charge in a second direction while said door maintains compression in said first direction, said compression achieving a reduction of said charge to about 10–20% of its original volume;

(d) moving a ram in said compaction chamber to further compress said charge in a third direction while said ram in said hopper maintains compression in said second direction, said compression producing a pellet having about 3–5% of the volume of the original charge;

(e) removing moisture from said pellet by use of an electrical heating element;

(f) sensing the values of heat, pressure and moisture of said pellet in said compaction chamber; and (g) ejecting said pellet when predetermined end points for said values are sensed.

* * * * *